US012130030B2

(12) United States Patent
Liu et al.

(10) Patent No.: US 12,130,030 B2
(45) Date of Patent: Oct. 29, 2024

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Fashen Liu, Foshan (CN); Hui Yu, Foshan (CN); Yu Liu, Foshan (CN); Kangwen Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 307 days.

(21) Appl. No.: 17/778,945

(22) PCT Filed: Mar. 3, 2020

(86) PCT No.: PCT/CN2020/077622
§ 371 (c)(1),
(2) Date: May 23, 2022

(87) PCT Pub. No.: WO2021/134896
PCT Pub. Date: Jul. 8, 2021

(65) Prior Publication Data

US 2022/0412577 A1 Dec. 29, 2022

(30) Foreign Application Priority Data

Dec. 31, 2019 (CN) ..... 201911425732.4
Dec. 31, 2019 (CN) ..... 201922499031.7

(51) Int. Cl.
*F24F 1/031* (2019.01)
*F24F 1/027* (2019.01)
*F24F 1/029* (2019.01)

(52) U.S. Cl.
CPC ..... *F24F 1/031* (2019.02); *F24F 1/027* (2013.01); *F24F 1/029* (2019.02)

(58) Field of Classification Search
CPC ..... F24F 1/031; F24F 11/88; F24F 11/89
See application file for complete search history.

(56) References Cited

U.S. PATENT DOCUMENTS 6,336,338 B1 * 1/2002 Koren ..... F24F 1/027 62/262
2003/0042010 A1 3/2003 Kobayashi et al.

FOREIGN PATENT DOCUMENTS

CN 206191771 U 5/2017
CN 206472411 U 9/2017
(Continued)

OTHER PUBLICATIONS

World Intellectual Property Organization (WIPO) International Search Report and Written opinion for PCT/CN2020/077622 Sep. 28, 2020 17 Pages (Translation Included).
(Continued)

*Primary Examiner* — Joseph F Trpisovsky
(74) *Attorney, Agent, or Firm* — Anova Law Group, PLLC

(57) ABSTRACT

A window air conditioner includes a chassis, a housing including an indoor-side housing and an outdoor-side housing respectively arranged at two sides of the chassis, an electric control box installed at the chassis and located in the outdoor-side housing, a junction box arranged in the indoor-side housing, and a wiring plate arranged at the chassis and including a power supply wire slot, a strong electric wire slot, and a weak electric wire slot isolated from each other. A power wire electrically connected to the electric control box is arranged in the power supply wire slot. A strong electric wire electrically connected to at least one of the electric control box or the junction box is arranged in the
(Continued)

strong electric wire slot. A weak electric wire electrically connected to the electric control box is arranged in the weak electric wire slot.

17 Claims, 10 Drawing Sheets

(56) References Cited

FOREIGN PATENT DOCUMENTS

| | | | |
|---|---|---|---|
| CN | 208920420 | U | 5/2019 |
| CN | 109959079 | A | 7/2019 |
| CN | 209558560 | U | 10/2019 |
| CN | 209763320 | U | 12/2019 |
| CN | 209763321 | U | 12/2019 |
| CN | 209857232 | U | 12/2019 |
| CN | 211400074 | U | 9/2020 |
| JP | H0993767 | A | 4/1997 |
| KR | 20040015875 | A | 2/2004 |
| KR | 20190009971 | A | 1/2019 |
| WO | 2016180255 | A1 | 11/2016 |

OTHER PUBLICATIONS

The China National Intellectual Property Administration (CNIPA) The First Office Action for Chinese Application 201911425732.4 Aug. 19, 2024 21 Pages (With Translation).

* cited by examiner

WINDOW AIR CONDITIONER

CROSS-REFERENCE TO RELATED APPLICATIONS

The present application is a National Stage Entry under 35 U.S.C. § 371 of International Application No. PCT/CN2020/077622, filed on Mar. 3, 2020, which claims priority to Chinese patent application Nos. 201911425732.4 and 201922499031.7, both filed on Dec. 31, 2019 and titled "Window Air Conditioner," the entire contents of all of which are incorporated herein by reference.

TECHNICAL FIELD

The present application relates to the technical field of air conditioners, in particular to a window air conditioner.

BACKGROUND

Window air conditioners are more and more widely used due to their convenient use and simple installation. Since a large number of electrical devices are provided in an air conditioner, an electric control box and a junction box are provided in the air conditioner to facilitate electrical connection and control of these electrical devices. In the exemplary technology, various wires are usually provided to electrically connect the electric control box, the junction box and the electrical devices to ensure the normal operation of these electrical devices. However, in the exemplary technology, the electric control box, the junction box and the connecting wires are arranged in a relatively chaotic manner, which not only occupies a large space, but further makes the wiring more chaotic and reduces the wiring efficiency.

SUMMARY

The main purpose of the present application is to provide a window air conditioner, which aims to solve the technical problems in the exemplary technology of chaotic arrangement of electric control boxes, junction boxes, and connecting wires, and occupying a large space.

In order to achieve the above objectives, the present application proposes the following technical solutions:

a window air conditioner, including:

a chassis;

a housing including an indoor-side housing and an outdoor-side housing respectively arranged at two sides of the chassis;

an electric control box installed at the chassis and located in the outdoor-side housing;

a junction box arranged in the indoor-side housing; and a wiring plate arranged at the chassis, in particular the wiring plate is formed with a power supply wire slot, a strong electric wire slot and a weak electric wire slot isolated from each other, and a power wire electrically connected to the electric control box is arranged in the power supply wire slot, a strong electric wire electrically connected to the electric control box, or electrically connected to both the electric control box and the junction box, is arranged in the strong electric wire slot, and a weak electric wire electrically connected to the electric control box is arranged in the weak electric wire slot.

Optionally, a plurality of wire slot side walls protrude from the wiring plate, the power supply wire slot, the strong electric wire slot and the weak electric wire slot are respectively formed between two adjacent wire slot side walls, and wire buckles protrude from the plurality of wire slot side walls.

Optionally, an indoor air duct shell is provided at the chassis, the indoor air duct shell is located in the indoor-side housing, and the wiring plate is arranged between the indoor air duct shell and the electric control box.

Optionally, the power supply wire slot and the weak electric wire slot are respectively arranged at two sides of the wiring plate, and the strong electric wire slot is arranged close to the weak electric wire slot;

the power supply wire slot is curved and extends from one side of the indoor air duct shell to the electric control box, and both the strong electric wire slot and the weak electric wire slot are curved and extend from another side of the indoor air duct shell to the electric control box.

Optionally, a bottom of the electric control box is provided with a wire inlet/outlet slot, the wire inlet/outlet slot is arranged corresponding to a middle position of the wiring plate, and the power supply wire slot, the strong electric wire slot and the weak electric wire slot are all close to the wire inlet/outlet slot.

Optionally, the electric control box includes a box base arranged at the chassis and a box body arranged at the box base;

a bottom of the box body is provided with a plurality of wire inlet/outlet slots adjacent to each other, and the power supply wire slot, the strong electric wire slot and the weak electric wire slot respectively correspond to the plurality of wire inlet/outlet slots.

Optionally, a power supply auxiliary wire slot is formed between a side of the indoor air duct shell and the indoor-side housing, the power supply auxiliary wire slot is connected to the power supply wire slot, and the power wire extends from the indoor-side housing into the power supply auxiliary wire slot, then into the power supply wire slot, and then into the electric control box.

Optionally, the strong electric wire slot includes a motor strong electric wire slot and a compressor strong electric wire slot respectively arranged at the wiring plate, a motor strong electric wire is arranged in the motor strong electric wire slot, and the compressor strong electric wire is arranged in the compressor strong electric wire slot;

the chassis is provided with a compressor located in the outdoor-side housing, and the compressor strong electric wire is led out from the electric control box, and is guided along the compressor strong electric wire slot and electrically connected to the compressor;

an outdoor motor is provided in the outdoor-side housing, an indoor motor is provided in the indoor-side housing, and two motor strong electric wires are led out from the electric control box, and extend towards the junction box along the motor strong electric wire slot, and led out from the junction box to be electrically connected to the outdoor motor and the indoor motor, respectively.

Optionally, the motor strong electric wire includes a first motor strong electric wire and a second motor strong electric wire both disposed in the motor strong electric wire slot;

the first motor strong electric wire includes a first motor feeder wire and a first motor return wire, the first motor feeder wire is led out of the electric control box and introduced into the junction box along the motor strong electric wire slot, the first motor return wire is led out of the junction box and is electrically connected to the indoor motor;

the second motor strong electric wire includes a second motor feeder wire and a second motor return wire, the second motor feeder wire is led out of the electric control box and is led into the junction box along the motor strong electric wire slot, and the second motor return wire is led out of the junction box, and extend to be electrically connected to the outdoor motor.

Optionally, the indoor motor and the junction box are both provided at the indoor air duct shell, and the junction box is located below the indoor motor, and the first motor return wire is arranged along an outer wall of the indoor air duct shell.

Optionally, a bottom of the junction box is provided with a wire inlet/outlet opening, the first motor feeder wire and the second motor feeder wire are introduced into the junction box through the wire inlet/outlet opening, and the first motor return wire and the second motor return wire are led out of the junction box through the wire inlet/outlet opening;

the junction box is provided with a first connection terminal and a second connection terminal, the first motor feeder wire and the first motor return wire are electrically connected through the first connection terminal, and the second motor feeder wire and the second motor return wire are electrically connected through the second connection terminal.

Optionally, the compressor is arranged side by side with the electric control box, and the compressor strong electric wire slot is curved and extends from the electric control box to the indoor air duct shell, and then curved and extends towards the compressor.

Optionally, the compressor strong electric wire slot is in U-shape.

Optionally, the weak electric wire slot is curved and extends on the wiring plate from the electric control box to a side of the indoor air duct shell, and the weak electric wire includes an indoor weak electric wire and an outdoor weak electric wire, both the indoor weak electric wire and the outdoor weak electric wire extend along the weak electric wire slot to the side of the indoor air duct shell and led to the indoor-side housing and the outdoor-side housing, respectively.

Optionally, the weak electric wire slot includes a first weak electric slot section extending from the electric control box to a middle of the indoor air duct shell, and a second weak electric slot section extending from the middle of the indoor air duct shell to the side of the indoor air duct shell, and the first weak electric slot section is connected to the second weak electric slot section;

the compressor strong electric wire slot includes a first compressor slot section extending from the electric control box to the middle of the indoor air duct shell, and a second compressor slot section extending from the middle of the indoor air duct shell to the compressor, the first compressor slot section is connected to the second compressor slot section, and the first compressor slot section is overlapped with the first weak electric slot section.

Optionally, the housing is provided with a partition slot configured for a shutter located at a wall window to extend in, and the housing is separated by the partition slot into the indoor-side housing and the outdoor-side housing;

an indoor side cavity is formed inside the indoor-side housing, an outdoor side cavity is formed inside the outdoor-side housing, and the wiring plate is located between the indoor side cavity and the outdoor side cavity.

Optionally, the window air conditioner includes a seal that is movable installed at the partition slot, the seal is configured to switch between a storage state and a working state; in particular, in the storage state, the seal is received in the partition slot;

in the working state, the seal extends laterally from the partition slot and configured to abut against a shutter and/or an inner wall of the wall window.

In the technical solution proposed in the present application, by providing a wiring plate on the chassis, and providing a power supply wire slot, a strong electric wire slot and a weak wire slot on the wiring plate, and correspondingly arranging a power wire, a strong electric wire and a weak electric wire, so that various connecting wires are arranged separately. In this way, the electric control box, the junction box and the connecting wires can be arranged orderly and neatly on the chassis, which not only can reduce the mutual influence and interference between various connecting wires, but also can reduce the occupied space, and can make the wiring neat and simple, and improve the wiring efficiency.

BRIEF DESCRIPTION OF THE DRAWINGS

In order to more clearly illustrate the technical solutions in the embodiments of the present application or the exemplary technology, the following will briefly introduce the accompanying drawings required in the description of the embodiments or the exemplary technology. Obviously, the accompanying drawings in the following description are only some embodiments of the present application. For those of ordinary skill in the art, other drawings can be obtained according to the structure shown in these drawings without creative labor.

DESCRIPTION OF REFERENCE NUMBERS

Figure 1:
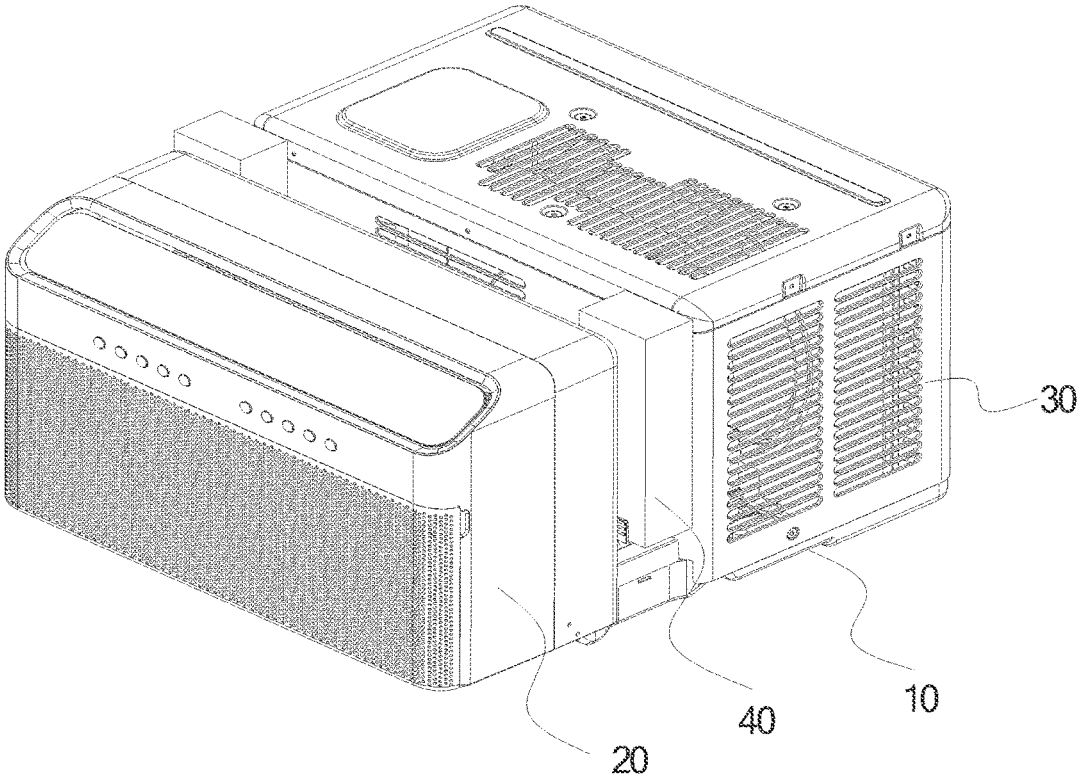
FIG. 1 is a perspective schematic structural diagram of a window air conditioner (when a seal is in a storage state) according to embodiments of the present application.

| Number | Name | Number | Name |
|---|---|---|---|
| 10 | Chassis | 20 | Indoor-side housing |
| 22 | Cross flow impeller | 24 | Display box |
| 25 | Indoor heat exchanger | 26 | Indoor motor |
| 30 | Outdoor-side housing | 32 | Electric control box |
| 34 | Outdoor motor | 35 | Compressor |
| 36 | Axial flow fan blade | 38 | Outdoor heat exchanger |
| 40 | Seal | 50 | Partition slot |
| 60 | Indoor air duct shell | 100 | Wiring plate |
| 110 | Power supply wire slot | 112 | Auxiliary power supply wire slot |
| 114 | Power wire | 120 | Strong electric wire slot |
| 122 | Motor strong electric wire | 130 | Compressor strong electric wire slot |
| 132 | Compressor strong electric wire | 140 | Weak electric wire slot |
| 142 | Weak electric wire | 200 | Junction box |
| 322 | Box body | 324 | Box base |
| 326 | Wire inlet/outlet slot | | |

The implementation, functional features, and advantages of the purpose of the present application will be further described with reference to the accompanying drawings in conjunction with the embodiments.

Detailed Description of the Embodiments

The following description will clearly and completely describe the technical schemes in the embodiments of the present application with reference to the drawings in the embodiments of the present application. Obviously, the described embodiments are only part of the embodiments of the present application, not all of them. Based on the embodiments in the present application, all other embodiments obtained by ordinary skilled in the art without creative labor are within the scope of the present application.

It should be noted that if a directional indication (such as up, down, left, right, front, rear, top, bottom, etc.) is involved in the embodiments of the present application, the directional indication is only used to explain the relative positional relationship, movement situation, etc. between the components under a specific posture (as shown in the drawings), and if the specific posture changes, the directional indication further changes accordingly.

In addition, if there is a description relating to "first," "second" and the like in the embodiments of the present application, the description of "first," "second" and the like is only for the purpose of description, and cannot be understood as indicating or implying the relative importance thereof or implicitly indicating the number of technical features indicated. Therefore, the features defined with "first" and "second" can explicitly or implicitly include at least one of the features. In addition, the technical solutions of various embodiments can be combined with each other, but it must be based on the realization of ordinary skilled in the field. When the combination of technical solutions is contradictory or impossible, it should be considered that the combination of such technical solutions does not exist and is not within the claimed scope of this application.

Figure 2:
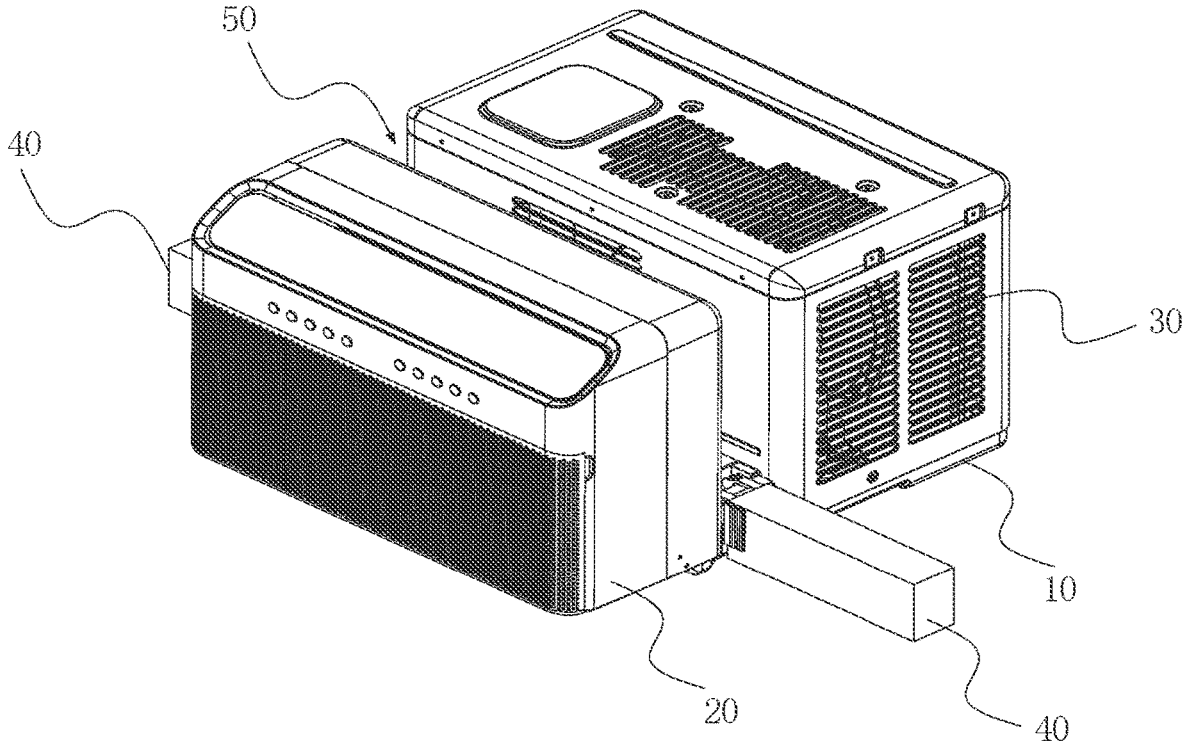
FIG. 2 is a perspective schematic structural diagram of the window air conditioner (when the seal is in a working state) according to embodiments of the present application.

According to FIGS. 1 to 2, the present application provides a window air conditioner. The window air conditioner may include a chassis 10, and a housing provided at the chassis 10. Moreover, the housing is provided with a partition slot 50 configured for a shutter located at a window of a wall extending in, and the partition slot 50 can divide the housing into an indoor-side housing 20 and an outdoor-side housing 30. The indoor-side housing 20 is formed with an indoor side cavity inside, and the outdoor-side housing 30 is formed with an outdoor side cavity inside. Moreover, indoor components are provided in the indoor side cavity, and outdoor components are provided in the outdoor side cavity. Further, the window air conditioner may include a seal 40 that is rotatably installed at the partition slot 50, the seal 40 is configured to switch between a storage state and a working state. In particular, in the storage state, the seal 40 is received in the partition slot 50 (as shown in FIG. 1), and in the working state, the seal 40 protrudes laterally from the partition slot 50 (as shown in FIG. 2), and is configured to resist of the shutter and/or an inner wall of the window. Moreover, the shutter may be provided as a window sash, or a curtain, or a window louver.

Figure 3:
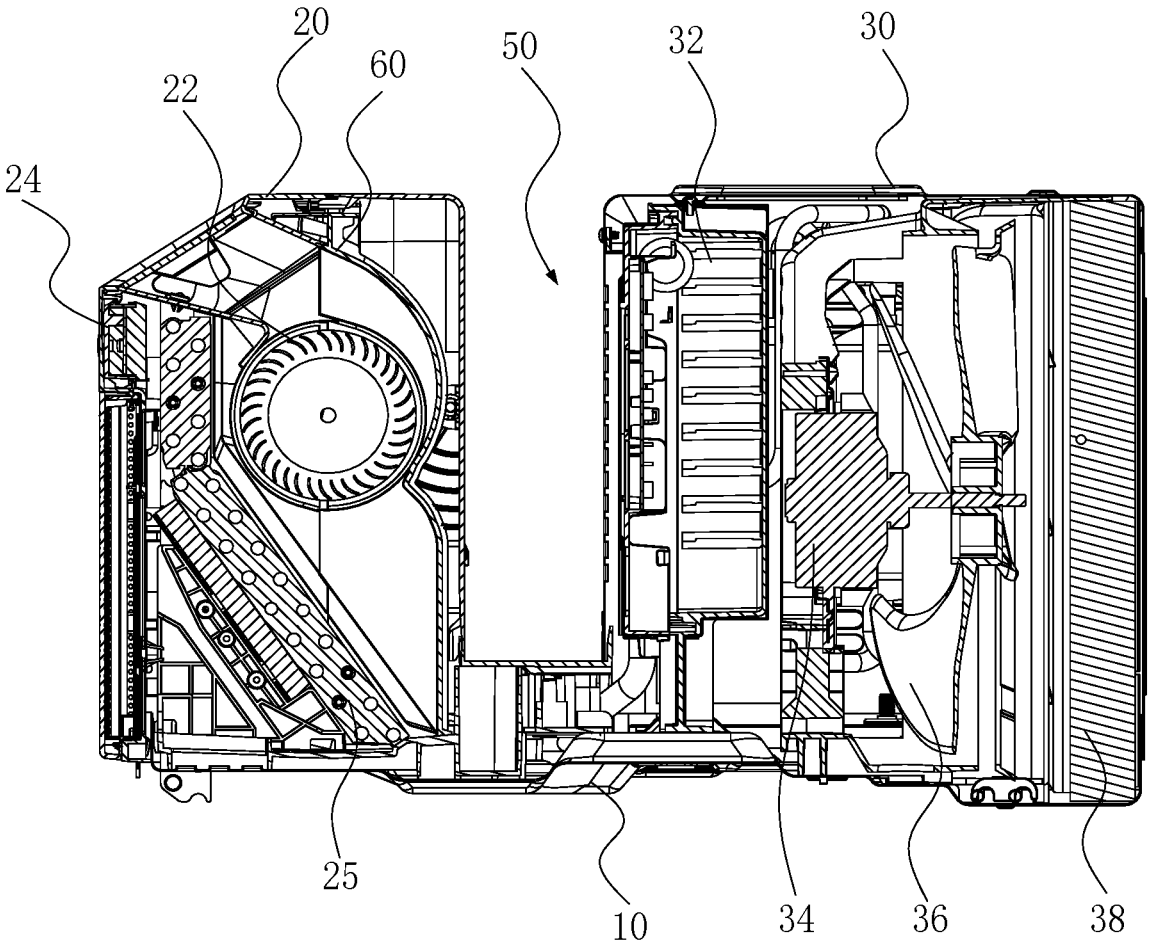
FIG. 3 is a longitudinal cross-sectional view of the window air conditioner according to embodiments of the present application.
Figure 4:
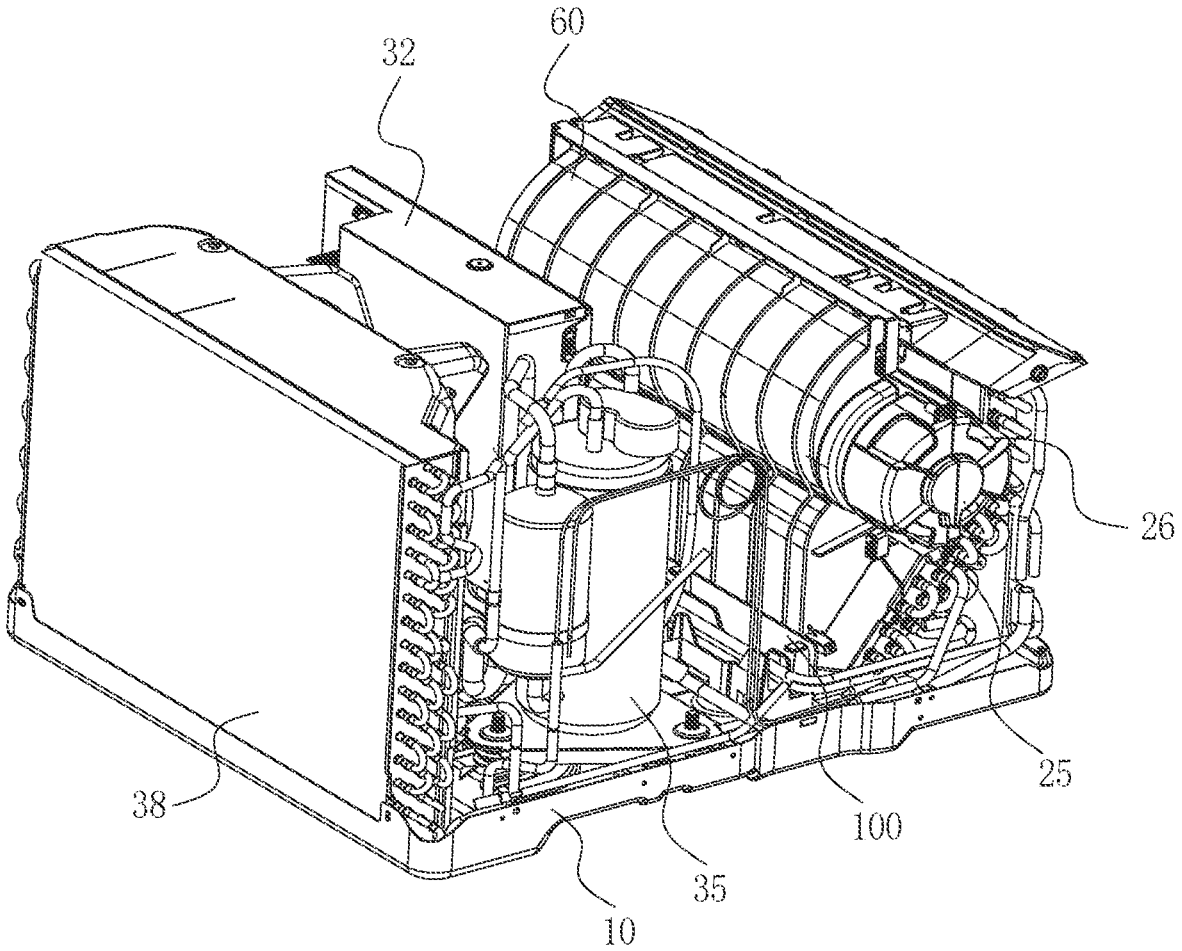
FIG. 4 is a perspective schematic structural diagram of the window air conditioner (when a housing is removed) according to embodiments of the present application.
Figure 5:
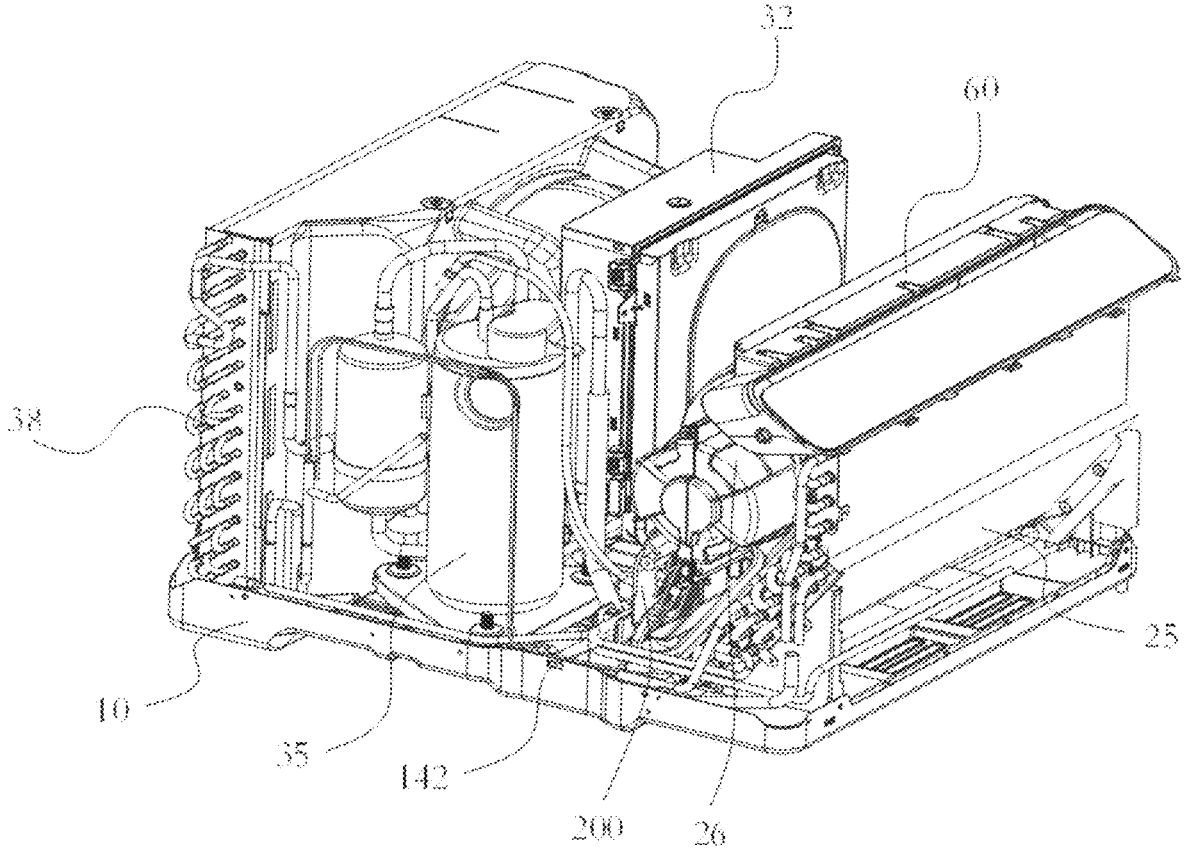
FIG. 5 is a perspective schematic structural diagram of the window air conditioner (when the housing is removed and the junction box is provided) according to embodiments of the present application.
Figure 6:
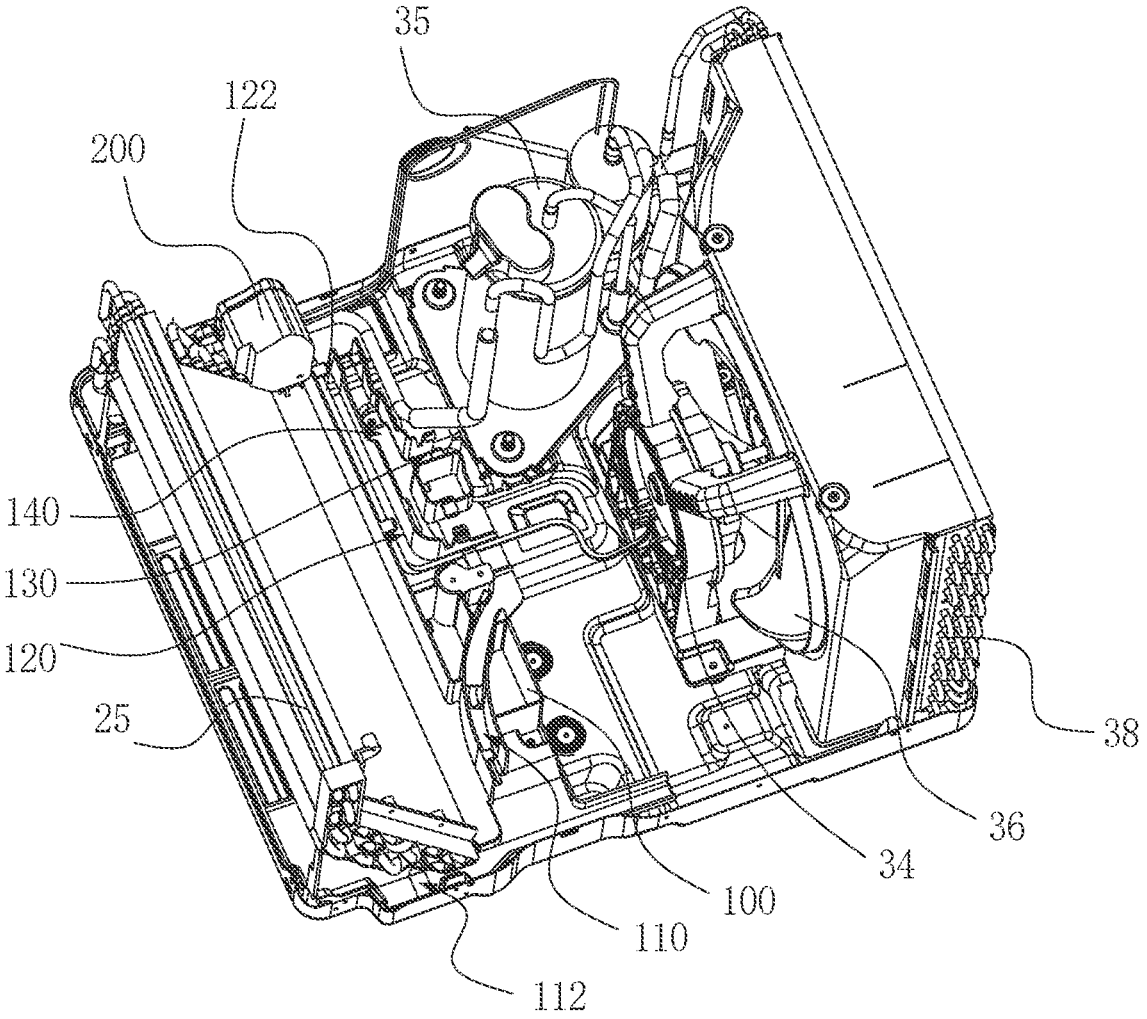
FIG. 6 is a perspective schematic structural diagram of the window air conditioner (when the housing and an indoor air duct shell are removed) according to embodiments of the present application.
Figure 7:
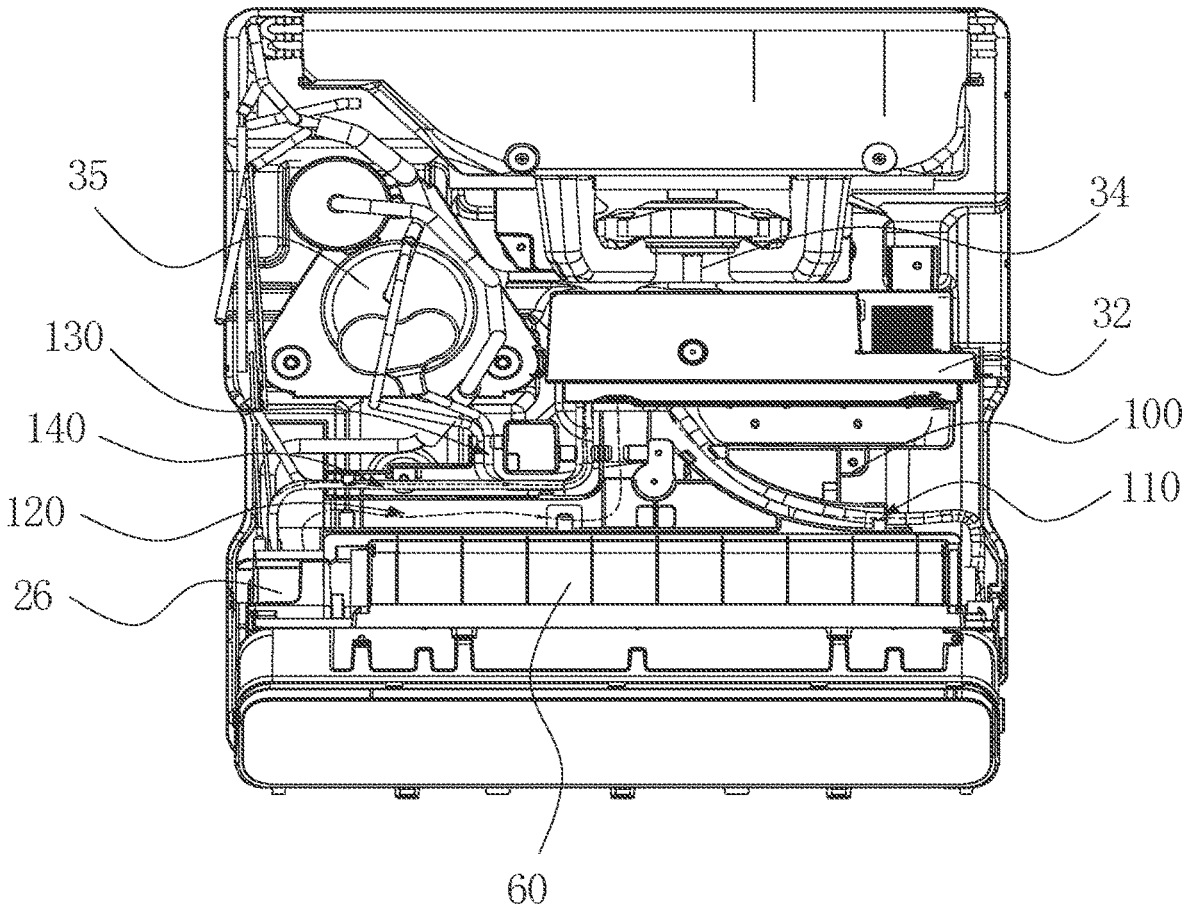
FIG. 7 is a top view of the window air conditioner (when the housing is removed) according to embodiments of the present application.
Figure 8:
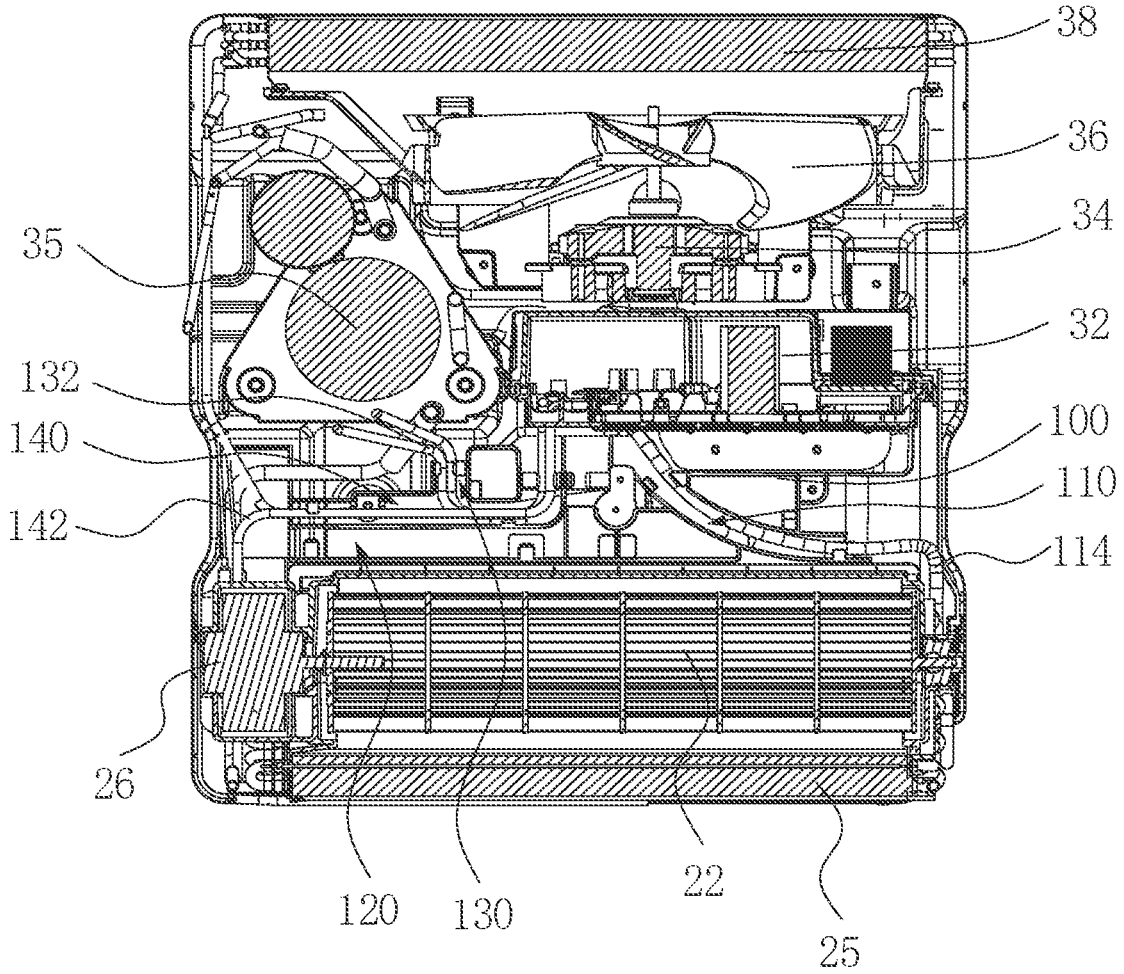
FIG. 8 is a horizontal cross-sectional view of the window air conditioner according to embodiments of the present application.

According to FIGS. 3 to 4, the outdoor components may include an electric control box 32, an outdoor motor 34, a compressor 35, an axial fan blade 36, an outdoor heat exchanger 38 and the like disposed in the outdoor side cavity, and the indoor components may include an indoor air duct assembly disposed in the indoor side cavity, a display box 24 (which may be disposed on the indoor-side housing 20), an indoor heat exchanger 25, and the like. Further, the indoor air duct assembly may be mounted on the chassis 10 and located in the indoor-side housing 20 of the housing. Further, the indoor air duct assembly may include an indoor air duct shell 60 disposed on the chassis 10 and located in the housing, an indoor motor 26 disposed on the indoor air duct shell 60, and a cross-flow impeller 22 disposed in the indoor air duct shell 60 and connected to the indoor motor.

According to FIGS. 5 to 8, the housing may include an indoor-side housing 20 and an outdoor-side housing 30 provided at two sides of the chassis 10, respectively. The electric control box 32 can be installed at the chassis 10 and located in the outdoor-side housing 30, and the junction box 200 is provided in the indoor-side housing 20. Moreover, the chassis 10 is further equipped with a wiring plate 100. Further, the wiring plate 100 may be formed with a power supply wire slot 110, a strong electric wire slot (120, 130) and a weak electric wire slot 140 mutually isolated from each other, and power wires 114 are arranged in the power supply wire slot 110 and electrically connected to the electric control box 32, and strong electric wires electrically connected to the electric control box 32 or electrically connected to the electric control box 32 and the junction box 200 are arranged in the strong electric wire slot, weak electric wires 142 electrically connected to the electric control box 32 is arranged in the weak electric wire slot 140. By arranging a wiring plate 100 on the chassis 10, and providing a power supply wire slot 110, a strong electric wire slot (120, 130) and a weak electric wire slot 140 on the wiring plate 100, and correspondingly arranging power wires 114, strong electric wires and weak electric wires 142, various connecting wires are arranged separately. In this way, the electric control box 32, the junction box 200 and the connecting wires can be arranged in an orderly and neat manner on the chassis 10, which can not only reduce a mutual influence and interference between various connecting wires, but further reduce an occupied space, make the wiring neat and simple, and improve the wiring efficiency.

Moreover, the wiring plate 100 can be separately arranged and detachably connected to the chassis 10, so that the wiring plate 100 can be processed and manufactured. In addition, the wiring plate 100 and the chassis 10 can further be integrated, which is firm and reliable. Moreover, the wiring plate 100 may be located between the indoor side cavity and the outdoor side cavity, and the wiring plate 100 may be arranged inside the partition slot between the indoor side cavity and the outdoor side cavity, so as to facilitate an arrangement of the connecting wires between the indoor side and the outdoor side of the air conditioner, to facilitate the electrical connection with the electrical devices on both sides, and to shorten the wire length. In addition, the junction box 200 may be provided at the inner wall of the indoor-side housing 20, or be provided at the chassis 10 in the indoor-side housing 20, or may be provided at the outer wall of the indoor air duct shell 60.

Further, a plurality of wire slot sidewalls may protrude from the wiring plate 100, each of the power supply wire slot 110, the strong electric wire slot (120, 130) and the weak electric wire slot 140 are respectively formed between two adjacent wire slot sidewalls, and wire buckles protrude from the wire slot sidewalls. Side walls can be arranged at the wiring plate 100 to form various wire slots (the power supply wire slot 110, the strong electric wire slots (120, 130) and the weak electric wire slots 140), and the wire slots can protrude from the wiring plate 100. In addition, the wire slots can further be recessed on the wiring plate 100. Moreover, other protruding structures on the wiring plate 100 (or the chassis 10) and the side walls of the wire slots can further be used to form the wire slots, in addition, the gaps between protruding structures on the wiring plate 100 (or on the chassis 10) can further be used to form the wire slots, in addition, the above situation can further be integrated to form a composite form of wire slots. The connecting wires (the power wire 114, the strong electric wire, the weak electric wire 142) are located in these wiring slots (the power supply wire slot 110, the strong electric wire slot (120, 130) and the weak electric wire slot 140). Moreover, the side wall of the wire slots can further be provided with a protruding wire buckle, which is configured to buckle the connecting wires in the wire slot, so that the connecting wires are not easy to break away from the wire slot, which can improve installation efficiency of the connecting wire, and make the connecting wire stable. Moreover, the wire slots are further divided into a power supply wire slot, strong electric wire slots and a weak electric wire slot according to a classification of the connecting wires, so as to separate various connecting wires, which is not only convenient for wiring, but further conducive to EMC (electromagnetic compatibility, electromagnetic compatibility) test of the whole machine.

Moreover, the chassis 10 is provided with an indoor air duct shell 60, and the indoor air duct shell 60 is located in the indoor-side housing 20, and the wiring plate 100 is provided between the indoor air duct shell 60 and the electric control box 32. The wiring plate 100 can be arranged at a middle position of the chassis 10 to facilitate wiring for electrical devices in various directions. In addition, the wiring plate can be positioned through the indoor air duct shell 60 and the electric control box 32.

Moreover, the power supply wire slot 110 and the weak electric wire slot 140 can be respectively arranged at two sides of the wiring plate 100, and the strong electric wire slots (120, 130) is arranged close to the weak electric wire slot 140. In this way, the power wire 114 and the strong electric wire can be respectively arranged at both sides of the wiring plate 100, so as to avoid the mutual influence of the two, and further facilitate the arrangement of the related electrical devices, and make the arrangement of the power wire 114 and the strong electric wire shorter and orderly, which can reduce the cost. Moreover, by arranging the weak electric wire 142 close to the strong electric wire, it is further convenient to arrange relevant electrical devices, and an overall wiring can be neat and orderly. Further, the power supply wire slot 110 can be bent and extend from a side of the indoor air duct shell 60 to the electric control box 32, and the strong electric wire slots (120, 130) and the weak electric wire slot 140 are bent and extend from the other side of the indoor air duct shell 60 to the electric control box 32. This makes it possible to arrange the power wire 110 on one side of the wiring plate 100, so that the power wire 110 can enter the indoor-side housing 20 from the side of the indoor air duct shell 60 and extend into the electric control box 32 along the power supply wire slot 110, and further makes it possible to arrange the strong and weak electric wires 142 on the other side of the wiring plate 100, so as to be separately disposed.

Figure 9:
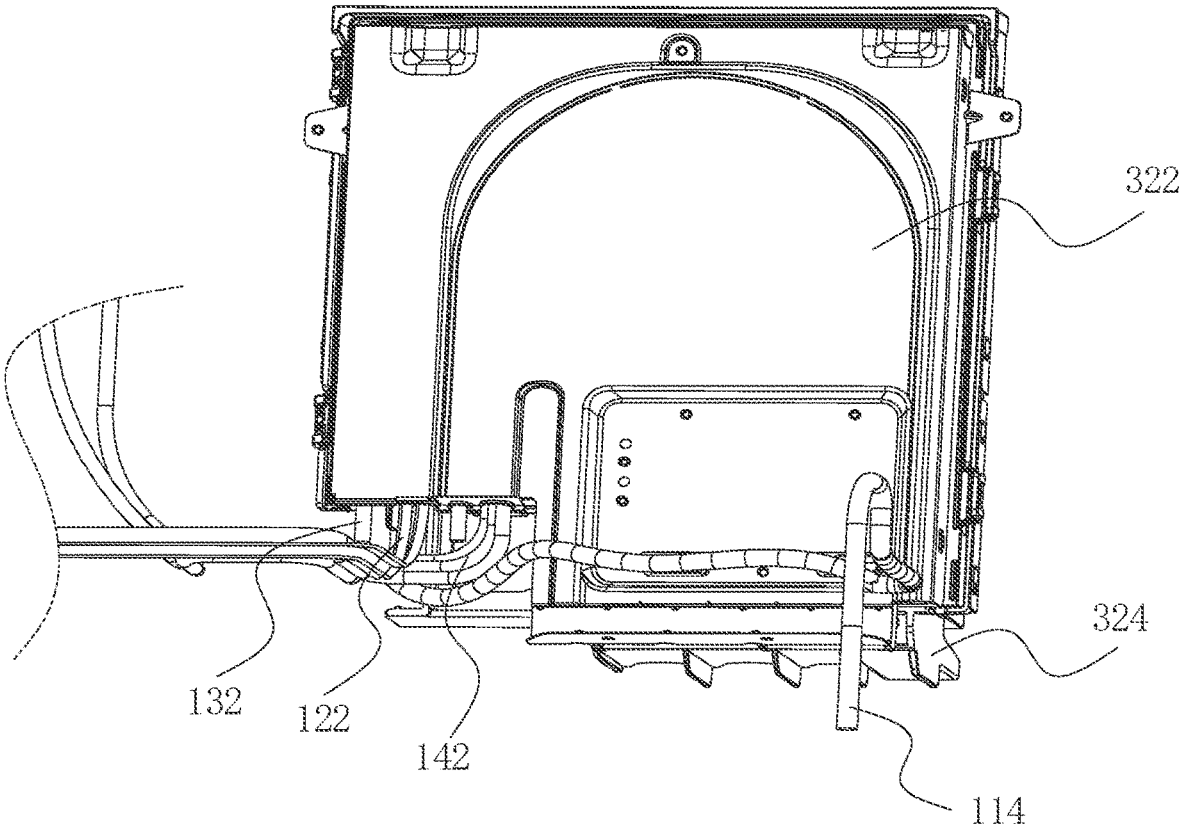
FIG. 9 is a perspective schematic structural diagram of an electric control box of the window air conditioner according to embodiments of the present application.
Figure 10:
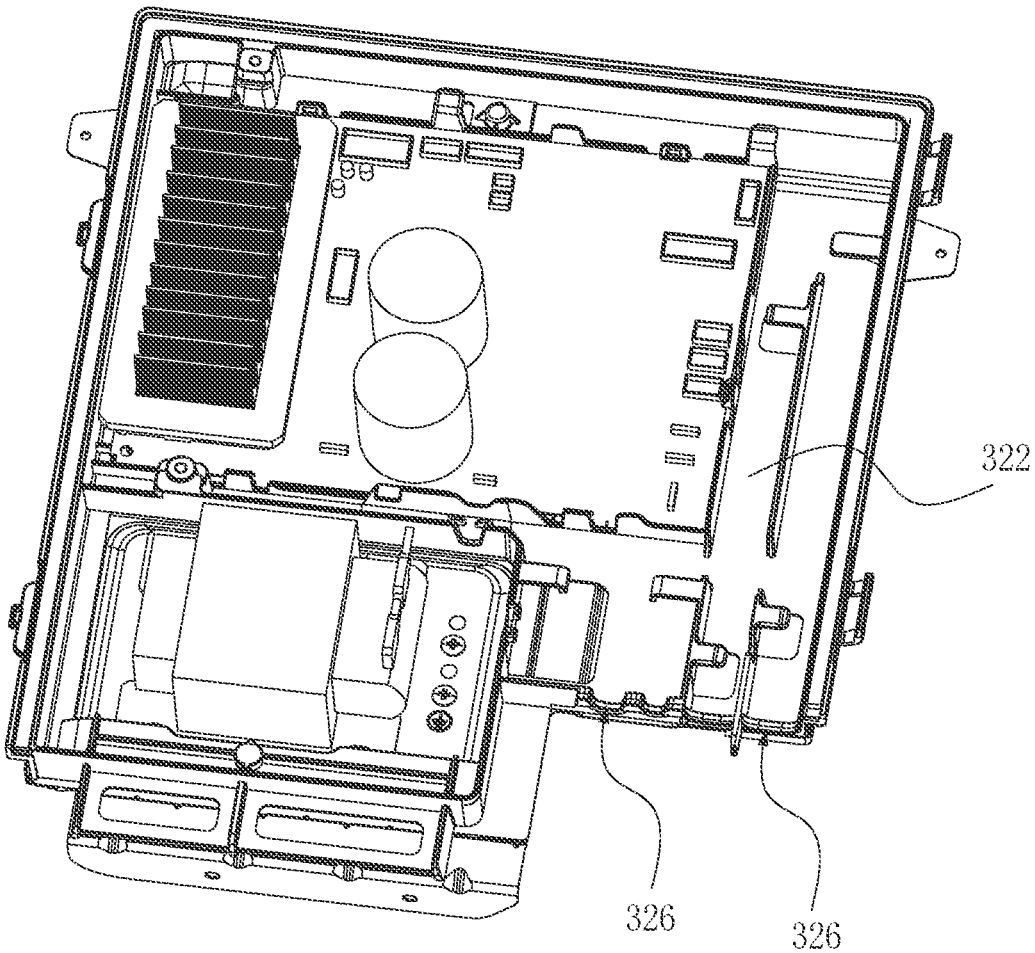
FIG. 10 is a perspective schematic structural diagram of the electric control box of the window air conditioner according to embodiments of the present application, with the electric control box is opened.

In addition, according to FIGS. 9 to 10, a bottom of the electric control box 32 is opened with a wire inlet/outlet slot 326, the wire inlet/outlet slot 326 corresponding to the middle position of the wiring plate 100, the power supply wire slot 110, strong electric wire slots (120, 130) and weak electric wire slot 140 are close to the wire inlet/outlet slot. It is convenient to bring together various connecting wires (the power wire 110, the strong electric wires (122, 132) and the weak electric wires 142) and introduce them into the electric control box 32 through the wire inlet/outlet slot arranged at the bottom of the electric control box 32, so as to facilitate centralized wiring. Moreover, the electric control box 32 may include a box base 324 provided at the chassis 10, and a box body 322 provided at the box base 324. By setting the box base 324, the box body 324 of the electric control box 32 can be set at a higher position, so as to facilitate the disposition of the wire inlet/outlet slot 326 at the bottom of the box body 322, facilitate wiring, and making it difficult for water on the chassis 10 to enter the electric control box 32. Moreover, the wire inlet/outlet slot 326 is arranged at the bottom of the box body 322, which is convenient for wiring on the chassis 10 and the wiring plate 100, and can further reduce the wiring length and save costs. Moreover, the bottom of the box body 10 is provided with a plurality of wire inlet/outlet slot 326 adjacent to each other, and the power supply wire slot 110, the strong electric wire slot (120, 130) and the weak electric wire slot 140 correspond to the plurality of wire inlet/outlet slot 326, respectively. By setting a plurality of wire inlet/outlet slots 326 on the box body 322 of the electric control box 32, connecting wires such as the power wire 114, the strong electric wire, the weak electric wire 142 and the like can be respectively introduced into or led out through different wire inlet/outlet slots 326, so as to separate these connecting wires, and the wiring is more clear, concise, neat and orderly. Moreover, these wire inlet/outlet slot 326 can correspond to each wire slot (the power supply wire slot 110, the strong electric wire slot (120, 130) and the weak electric wire slot 140), which is convenient for routing.

In addition, a power supply auxiliary wire slot 112 may be formed between the side of the indoor air duct shell 60 and the indoor-side housing 20, the power supply auxiliary wire slot 112 is in communication with the power supply wire slot 110, and the power wire 114 extends from the indoor-side housing 20 into the power supply auxiliary wire slot 112, then into the power supply wire slot 110, and then into the electric control box 32. In this way, a gap (i.e., the power supply auxiliary wire slot 112) between the side of the indoor air duct shell 60 and the side of the indoor-side housing 20 can be used, and a feed segment of the power wire 114 can be arranged at the chassis 10 at this gap, so that the power wire 114 enters the indoor-side housing 20 via the gap between the side of the indoor air duct shell 60 and the indoor-side housing 20 from the outside of the air conditioner, and then is introduced into the power supply wire slot 110 on the wiring plate 100 arranged between the indoor air duct shell 60 and the electric control box 32, and then led to the electric control box 32 through the power supply wire slot 110, so as to be electrically connected to the electric control box 32, and provide power for various electrical devices.

In addition, the strong electric wire slot may include a motor strong electric wire slot 120 and a compressor strong electric wire slot 130 respectively arranged at the wiring plate 100, the motor strong electric wire slot 120 is arranged with a motor strong electric wire 122, and the compressor strong electric wire slot 130 is arranged with a compressor strong electric wire 132. Moreover, the chassis 10 is provided with a compressor 35 located in the outdoor-side housing 30, and the compressor strong electric wire 132 is led out from the electric control box 32, advances along the compressor power supply wire slot 130 and is electrically connected to the compressor 35. Further, the outdoor-side housing 30 is provided with an outdoor motor 34, the indoor-side housing 20 is provided with an indoor motor 26, and two motor strong electric wires 122 are led out from the electric control box 32, run along the motor strong electric wire slot 120 to the junction box 200, and are led out from the junction box 200 to be electrically connected to the outdoor motor 34 and the indoor motor 26, respectively. That is to say, the strong electric wire slot includes the motor strong electric wire slot 120 and the compressor strong electric wire slot 130, which can be used to arrange the motor strong electric wire 122 and the compressor strong electric wire 132 respectively. The motor strong electric wire 122 can electrically connect the electric control box 32, the junction box 200, the indoor motor 26 and the outdoor motor 34, while the compressor strong electric wire 132 can electrically connect the electric control box 32 and the compressor 35. Therefore, the connecting wires of the two motors (the indoor motor 26 and the outdoor motor 34) and the compressor 35 can be arranged separately, and the wiring can be performed according to the arrangement of the motor and the compressor, so that the wiring is more neat and orderly, and the length of the connecting wires can be appropriately shortened.

Moreover, the motor strong electric wire slot 120 may include a first strong electric wire slot section provided at the wiring plate 100 and extending from the electric control box 32 to a rear side of the indoor air duct shell 60, and a second strong electric wire slot section extending from the first strong electric wire slot section to the junction box 200 along the rear side of the indoor air duct shell 60. The motor strong electric wire slot 120 can extend from the electric control box 32 to the indoor air duct shell 60, and then extend to the junction box 200 along the bottom of the indoor air duct shell 60, so that the motor strong electric wire 122 mainly extend along the bottom of the indoor air duct shell 60, which occupies less space and is convenient for wiring.

Further, the motor strong electric wire 122 may include a first motor strong electric wire and a second motor strong electric wire both disposed in the motor strong electric wire slot 120. The first motor strong electric wire and the second motor strong electric wire can be both arranged in the motor strong electric wire slot 120, so that the wiring is concentrated, simple and convenient. Moreover, the first motor strong electric wire may include a first motor feeder wire and a first motor return wire, the first motor feeder wire is led out from the electric control box 32 and led into the junction box 200 along the motor strong electric wire slot 120, the first motor return wire is led out from the junction box 200 and electrically connected to the indoor motor 26. Moreover, the second motor strong electric wire may include a second motor feeder wire and a second motor return wire, the second motor feeder wire is led out from the electric control box 32, and led into the junction box 200 along the motor strong electric wire slot 120, and the second motor return wire is led out from the junction box 200 and extends to the outdoor motor 34 to electrically connect the outdoor motor 34.

Moreover, both the indoor motor 26 and the junction box 200 can be disposed on the indoor air duct shell 60, and the junction box 200 is located below the indoor motor 26, and the first motor return wire is disposed along an outer wall of the indoor air duct shell 60. By arranging the junction box 200 on the side wall of the indoor air duct shell 60, the junction box 200 and the power supply wire slot 110 can be respectively arranged at two sides of the indoor air duct shell 60 to facilitate separate wiring. Moreover, by providing the junction box 200 on the indoor air duct shell 60 and below the indoor motor 26, the distance of the first motor return wire from the junction box 200 to the indoor motor 26 is shorter, and the length of the connecting wire is reduced. In addition, after the first motor return wire and the second motor return wire are led out from the junction box 200, since the junction box 200 is directly arranged at the indoor air duct shell 60, the first motor return wire can be directly arranged along the indoor air duct shell 60, for the second motor return wire is directed to the outdoor motor 34 in the outdoor-side housing 30, it is necessary for the second motor return wire to return along an original path of the motor strong electric wire slot 120 and pass through the electric control box 32 to electrically connect with the outdoor motor 34.

Further, a bottom of the junction box 200 is provided with a wire inlet/outlet opening, the first motor feeder wire and the second motor feeder wire enter into the junction box 200 through the wire inlet/outlet opening, and the first motor return wire and the second motor return wire come out of the junction box 200 through the wire inlet/outlet opening. By opening the wire inlet/outlet opening on the bottom of the junction box 200, the two motor feeder wires can be smoothly introduced into the junction box 200 after passing through the motor strong electric wire slot on the wiring plate 100 arranged at the chassis 10. In addition, the two motor return wires can be smoothly led out of the junction box 200 to be electrically connected to the two motors respectively, thus shortening lengths of the connecting wires. In addition, the junction box 200 can be suspended above the chassis 10, so that the bottom of the junction box 200 has an enough large gap for the wires to go out, which facilitates wiring at the bottom of the junction box 200, and prevents water from entering the junction box 200. In addition, the first motor feeder wire and the second motor feeder wire may be arranged side by side in the motor strong electric wire slot 120.

Moreover, the junction box 200 may be provided with a first connection terminal and a second connection terminal, the first motor feeder wire and the first motor return wire are electrically connected through the first connection terminal, and the second motor feeder wire and the second motor return wire are electrically connected through the second connection terminal. By setting connection terminals in the junction box 200, the motor feeder wires and the motor return wires can be electrically connected to facilitate wiring.

In addition, the compressor 35 may be arranged side by side with the electric control box 32, and the compressor strong electric wire slot 130 may be curved and extend in the direction from the electric control box 32 to the indoor air duct shell 60, and then curved and extend towards the compressor 35. By arranging the compressor 35 and the electric control box 32 side by side, the space of the outdoor-side housing 30 can be fully utilized, and a distance between the electric control box 32 and the compressor 35 can be shortened to reduce lengths of the connecting wires. Moreover, since the compressor 35 and the electric control box 32 are arranged close to each other, it is necessary to make the compressor strong electric wire 132 connecting the compressor 35 and the electric control box 32 curve, so that a curved compressor strong electric wire slot 130 is provided at the wiring plate 100 to facilitate wiring. Moreover, in this embodiment, the compressor strong electric wire slot 130 can be in a U-shape, so that the compressor strong electric wire 132 can further be correspondingly arranged in a U-shape, which facilitates the wiring arrangement of the compressor strong electric wire 132.

In addition, the weak wire slot 140 is curved and extends on the wiring plate 100 from the electric control box 32 to a side of the indoor air duct shell 60, and the weak electric wire 142 includes an indoor weak electric wire and an outdoor weak electric wire introduced from the electric control box 32. Both the indoor weak electric wire and the outdoor weak electric wire extend along the weak electric wire slot 140 to a side of the room air duct shell 60 and then lead to the indoor-side housing 20 and the outdoor-side housing 30 respectively. That is, the weak electric wire slot 140 and the corresponding weak electric wire 142 are arranged at one side of the motor strong electric wire slot 120 and the compressor strong electric wire slot 130, and are arranged separately from the power supply wire slot 110, so that the motor strong electric wire 122, the compressor strong electric wire 132 and the weak electric wire 142 can be arranged in a centralized manner to facilitate wiring. Moreover, the motor strong electric wire 122, the compressor strong electric wire 132 and the weak electric wire are isolated from each other and have less influence on each other. Further, according to different applications, the weak electric wire 142 can be divided into an indoor weak electric wire and an outdoor weak electric wire to be electrically connected to indoor side electric devices (such as an indoor side sensor) and an outdoor electric device (such as an outdoor side sensor) respectively. Moreover, the indoor weak electric wire and the outdoor weak electric wire can be both arranged in the weak electric wire slot 140 to carry out centralized wiring, which is convenient and simple. When the indoor weak electric wire and the outdoor weak electric wire pass through the weak electric wire slot 140 to an edge position of the chassis 10, they are respectively led to the electric devices on the indoor side and the electric devices on the outdoor side. In addition, a plurality of indoor weak electric wires and a plurality of outdoor weak electric wires may be provided so as to be electrically connected to a plurality of sensors or other electrical devices, respectively.

Further, the weak electric wire slot 140 may include a first weak electric slot section extending from the electric control box 32 to a middle of the indoor air duct shell 60, and a second weak electric slot section extending from the middle of the indoor air duct shell 60 to a side of the indoor air duct shell 60. The first weak electric slot section is connected to the second weak electric slot section. Moreover, the compressor strong electric wire slot 130 may include a first compressor slot section extending from the electric control box 32 to the middle of the indoor air duct shell 60, and a second compressor slot section extending from the middle of the indoor air duct shell 60 to the compressor 35. The first compressor slot section is connected to the second compressor slot section, and the first compressor slot section overlaps with the first weak electric slot section. That is, the weak electric wire slot 140 and the compressor strong electric wire slot 130 can be at least overlapped with each other, which is convenient to arrange the weak electric wire 142 and the compressor strong electric wire 132 close to each other, and is convenient for centralized wiring.

In addition, in this embodiment, the bottom of the electric control box 32 may be provided with four wire inlet/outlet slots 326, one of which is used to introduce the power wire 114, and may further used to lead out the compressor strong electric wire 132, another one of the wire inlet/outlet slots 326 is used to lead out the indoor weak electric wire, a third one of the wire inlet/outlet slots 326 is used to lead out the outdoor weak electric wire, and a fourth one of the wire inlet/outlet slots 326 is used to lead out the motor strong electric wire. In this way, the various connecting wires can be introduced into the electric control box and led out of the electric control box in an orderly manner. Further, the four wire inlet/outlet slots 326 can be arranged close together and located in the middle of the chassis 10. By setting the four wire inlet/outlet slot 326, the routing can be concentrated. Moreover, by arranging the wire inlet/outlet slots 326 at the middle position of the chassis 10, the distances from the connecting wires to the electric devices at other positions can be made shorter.

The above description is only a preferred embodiment of the present application, and does not limit the scope of the present application. Any equivalent structural transformation made under the inventive concept of the present application using the specification of the present application and the accompanying drawings, or any direct/indirect application in other related technical fields, is included in the claimed scope of the present application.

What is claimed is:

1. A window air conditioner comprising:

a chassis;

a housing including an indoor-side housing and an outdoor-side housing respectively arranged at two sides of the chassis;

an electric control box installed at the chassis and located in the outdoor-side housing;

a junction box arranged in the indoor-side housing; and a wiring plate arranged at the chassis and including a power supply wire slot, a strong electric wire slot, and a weak electric wire slot isolated from each other;

wherein:

a power wire electrically connected to the electric control box is arranged in the power supply wire slot;

a strong electric wire electrically connected to at least one of the electric control box or the junction box is arranged in the strong electric wire slot; and a weak electric wire electrically connected to the electric control box is arranged in the weak electric wire slot.

2. The window air conditioner according to claim 1, wherein:

the wiring plate includes a plurality of wire slot side walls and a plurality of wire buckles each formed at and protruding from one of the plurality of wire slot side walls; and each of the power supply wire slot, the strong electric wire slot, and the weak electric wire slot is formed between two adjacent ones of the wire slot side walls.

3. The window air conditioner according to claim 1, further comprising:

an indoor air duct shell provided at the chassis and located in the indoor-side housing;

wherein the wiring plate is arranged between the indoor air duct shell and the electric control box.

4. The window air conditioner according to claim 3, wherein:

the power supply wire slot and the weak electric wire slot are respectively arranged at two sides of the wiring plate;

the strong electric wire slot is arranged close to the weak electric wire slot;

the power supply wire slot is curved and extends from one side of the indoor air duct shell to the electric control box; and the strong electric wire slot and the weak electric wire slot are curved and extend from another side of the indoor air duct shell to the electric control box.

5. The window air conditioner according to claim 3, wherein a bottom of the electric control box is provided with a wire inlet/outlet slot, the wire inlet/outlet slot is arranged corresponding to a middle position of the wiring plate, and the power supply wire slot, the strong electric wire slot, and the weak electric wire slot are close to the wire inlet/outlet slot.

6. The window air conditioner according to claim 5, wherein:

the electric control box includes a box base arranged at the chassis and a box body arranged at the box base;

the wire inlet/outlet slot is one of a plurality of wire inlet/outlet slots provided adjacent to each other at a bottom of the box body; and each of the power supply wire slot, the strong electric wire slot, and the weak electric wire slot corresponds to one of the plurality of wire inlet/outlet slots.

7. The window air conditioner according to claim 3, wherein a power supply auxiliary wire slot is formed between a side of the indoor air duct shell and the indoor-side housing, the power supply auxiliary wire slot is connected to the power supply wire slot, and the power wire extends from the indoor-side housing into the power supply auxiliary wire slot, into the power supply wire slot, and into the electric control box.

8. The window air conditioner according to claim 3, further comprising:

a compressor provided at the chassis and located in the outdoor-side housing;

an outdoor motor provided in the outdoor-side housing; and an indoor motor provided in the indoor-side housing;

wherein:

the strong electric wire slot includes a motor strong electric wire slot and a compressor strong electric wire slot arranged at the wiring plate;

a compressor strong electric wire is led out from the electric control box, and is guided along the compressor strong electric wire slot and electrically connected to the compressor; and two motor strong electric wires are led out from the electric control box, and extend towards the junction box along the motor strong electric wire slot, and are led out from the junction box to be electrically connected to the outdoor motor and the indoor motor, respectively.

9. The window air conditioner according to claim 8, wherein:

the two motor strong electric wires include a first motor strong electric wire and a second motor strong electric wire both disposed in the motor strong electric wire slot;

the first motor strong electric wire includes:

a first motor feeder wire extending from the electric control box and into the junction box along the motor strong electric wire slot; and a first motor return wire extending from the junction box and electrically connected to the indoor motor; and the second motor strong electric wire includes:

a second motor feeder wire extending from the electric control box and into the junction box along the motor strong electric wire slot; and a second motor return wire extending from the junction box and toward the outdoor motor to be electrically connected to the outdoor motor.

10. The window air conditioner according to claim 9, wherein:

the indoor motor and the junction box are both provided at the indoor air duct shell;

the junction box is located below the indoor motor; and the first motor return wire is arranged along an outer wall of the indoor air duct shell.

11. The window air conditioner according to claim 10, wherein:

a bottom of the junction box is provided with a wire inlet/outlet opening;

the first motor feeder wire and the second motor feeder wire extend into the junction box through the wire inlet/outlet opening;

the first motor return wire and the second motor return wire extend out of the junction box through the wire inlet/outlet opening;

the junction box is provided with a first connection terminal and a second connection terminal;

the first motor feeder wire and the first motor return wire are electrically connected to each other through the first connection terminal; and the second motor feeder wire and the second motor return wire are electrically connected to each other through the second connection terminal.

12. The window air conditioner according to claim 8, wherein:

the compressor is arranged side by side with the electric control box; and the compressor strong electric wire slot is curved and extends from the electric control box to the indoor air duct shell, and towards the compressor.

13. The window air conditioner according to claim 12, wherein the compressor strong electric wire slot is in U-shape.

14. The window air conditioner according to claim 3, wherein:

the weak electric wire slot is curved and extends on the wiring plate from the electric control box to a side of the indoor air duct shell;

the weak electric wire includes an indoor weak electric wire and an outdoor weak electric wire both extending along the weak electric wire slot to the side of the indoor air duct shell and extending to the indoor-side housing and the outdoor-side housing, respectively.

15. The window air conditioner according to claim 14, wherein:

the weak electric wire slot includes:

a first weak electric slot section extending from the electric control box to a middle of the indoor air duct shell; and a second weak electric slot section connected to the first weak electric slot section and extending from the middle of the indoor air duct shell to the side of the indoor air duct shell; and the compressor strong electric wire slot includes:

a first compressor slot section extending from the electric control box to the middle of the indoor air duct shell and overlapped with the first weak electric slot section; and a second compressor slot section connected to the first compressor slot section and extending from the middle of the indoor air duct shell to the compressor.

16. The window air conditioner according to claim 1, wherein:

the housing is provided with a partition slot separating the housing into the indoor-side housing and the outdoor-side housing, and is configured for a shutter to extend into the partition slot;

an indoor side cavity is formed inside the indoor-side housing;

an outdoor side cavity is formed inside the outdoor-side housing; and the wiring plate is located between the indoor side cavity and the outdoor side cavity.

17. The window air conditioner according to claim 16, further comprising:

a seal movably installed at the partition slot, and configured to switch between:

a storage state, in which the seal is received in the partition slot; and a working state, in which the seal extends laterally from the partition slot.

* * * * *